United States Patent [19]

Deutsch et al.

[11] 4,244,263

[45] Jan. 13, 1981

[54] TONE SELECTION CONTROL FOR AN ELECTRONIC MUSICAL INSTRUMENT

[75] Inventors: Ralph Deutsch; Leslie J. Deutsch, both of Sherman Oaks, Calif.

[73] Assignee: Kawai Musical Instrument Mfg. Co., Ltd., Hamamatsu, Japan

[21] Appl. No.: 970,749

[22] Filed: Dec. 18, 1978

[51] Int. Cl.[3] ..... G10B 3/10

[52] U.S. Cl. ..... 84/345; 84/370

[58] Field of Search ..... 84/345, 344, 370, 1.01

[56] References Cited

U.S. PATENT DOCUMENTS

| | | | |
|---|---|---|---|
| 3,926,087 | 12/1975 | Griffis | 84/345 |
| 4,000,658 | 2/1977 | Kappes | 84/345 |
| 4,078,465 | 3/1978 | Wheelwright | 84/345 |
| 4,129,055 | 12/1978 | Whittington | 84/1.01 |

*Primary Examiner*—L. T. Hix

*Assistant Examiner*—S. D. Schreyer

*Attorney, Agent, or Firm*—Christie, Parker & Hale

[57] ABSTRACT

Apparatus for sequencing an electronic organ through a plurality of different combinations of tone settings utilizes an addressable memory to store each setting combination as a separate addressable word in which each bit of the word indicates the setting of one tone characteristic. The words are read out in predetermined sequence at times controlled by the musician, the bits of each word controlling the immediate setting of all the tone control switches. Any word in memory can be read out at any time on command of the musician independently of the sequencing to establish a selected preset status of the tone control switches. The automatic setting of any tone control switch can be manually overridden at any time and the corresponding bit in associated control word in memory changed accordingly.

1 Claim, 2 Drawing Figures

TONE SELECTION CONTROL FOR AN ELECTRONIC MUSICAL INSTRUMENT

FIELD OF THE INVENTION

This invention relates to electronic musical instruments, and more particularly, is concerned with apparatus for controlling tone selection in an electronic musical instrument.

BACKGROUND OF THE INVENTION

Electronic musical instruments, such as electronic organs, are provided with a number of controls for producing different tone effects. For example, many electronic organs have a number of switches which correspond to the musical stops of a pipe organ. Some electronic organs have drawbar controls which are adjusted to produce various tonal effects. The stops, drawbars, or other special effects controls are preset by the musician to produce the desired tonal effects during the playing of a musical number. It is frequently desirable to change the tonal effect by repositioning the controls during the performance of a number. Various systems have been devised for simplifying the resetting of the tone controls so that the musician by changing a single control, can cause the resetting of a large number of associated tone controls. A single actuating control for setting a plurality of tone controls is referred to as a "piston", a term borrowed from pipe organ technology. The piston in the pipe organ provides a way of setting a plurality of stops simultaneously by actuating a single piston. Various types of such combination systems have been provided in the past. In the simplest system a selected set of tone controls is permanently connected to a given piston, so that operation of the piston establishes a predetermined tonal effect which can only be altered by changing the wiring of the controls. A more versatile arrangement is provided by bringing all the wiring out to a plug board or other convenient arrangement for modifying the wiring connections between the piston control and the various tone control switches. More sophisticated and versatile combination systems, referred to as "capture combination systems" are available in which some sort of memory is used which can remember any combination of stops. Each combination can be recalled by actuating a piston which operates to address the location in memory where the particular combination of stops is stored in coded form. The capture combination systems are preferred by the musician because they are the simplest to adjust and offer the most flexibility in performance. However, known capture combination systems are relatively expensive and so are found only on the more expensive electronic musical instruments. Another problem with known capture combination systems is that on the less expansive units there is no visual indication of the setting of the tone controls in response to the operation of a selected piston. Systems have been deviced in which the stop switches or drawbars are mechanically positioned in the same manner as though they had been set by the musician. However, such mechanical setting of the stops and other tone controls adds substantially to the cost of the capture combination system.

An additional problem with such known systems is that the musician must remember the tone control settings that are associated with each piston, so that he will select the correct piston when modifying the tone control settings. One memory technique that has been used is to number the control pistons and then write the piston numbers on the musical score at the bars at which a tone control change is to be made.

SUMMARY OF THE INVENTION

The present invention is directed to an improved capture combination system of selecting different combinations of tone settings which is considerably less expensive and more conventient to operate than such known prior art capture combination systems. The present invention provides a visual indication of the current status of all stops and other tone control switches. It also provides for automatic sequencing of the combination settings using a single switch while at the same time permitting operation by dedicated pistons, if so desired. A manual override of any tone control independent of a piston control combination is provided. Piston control can be used to restart a sequence at any point in the control cycle.

These and other advantages of the present invention are achieved by providing a capture combination tone setting system for an electronic organ, or the like, having a plurality of tone control stops which can be individually turned on or off. A bistable device such as a flip-flop is associated with each stop for setting the stop on or off. A control circuit associated with each flip-flop includes a tone control switch for setting the associated flip-flop. An addressable read/write memory for storing a plurality of tone setting control words in separately addressable locations is addressed by a counter. Means responsive to the state of the flip-flops generates a word coded to identify the state of each of the flip-flops. Means including a write control switch stores said word in memory when the switch is actuated at the address fixed by the counter. A sequence control switch is actuated for reading out a word from the address in memory fixed by the counter, setting the flip-flops in response to said word and incrementing the counter.

BRIEF DESCRIPTION OF THE DRAWINGS

For a better understanding of the invention reference should be made to the accompanying drawings, wherein.

DETAILED DESCRIPTION

Figure 1:
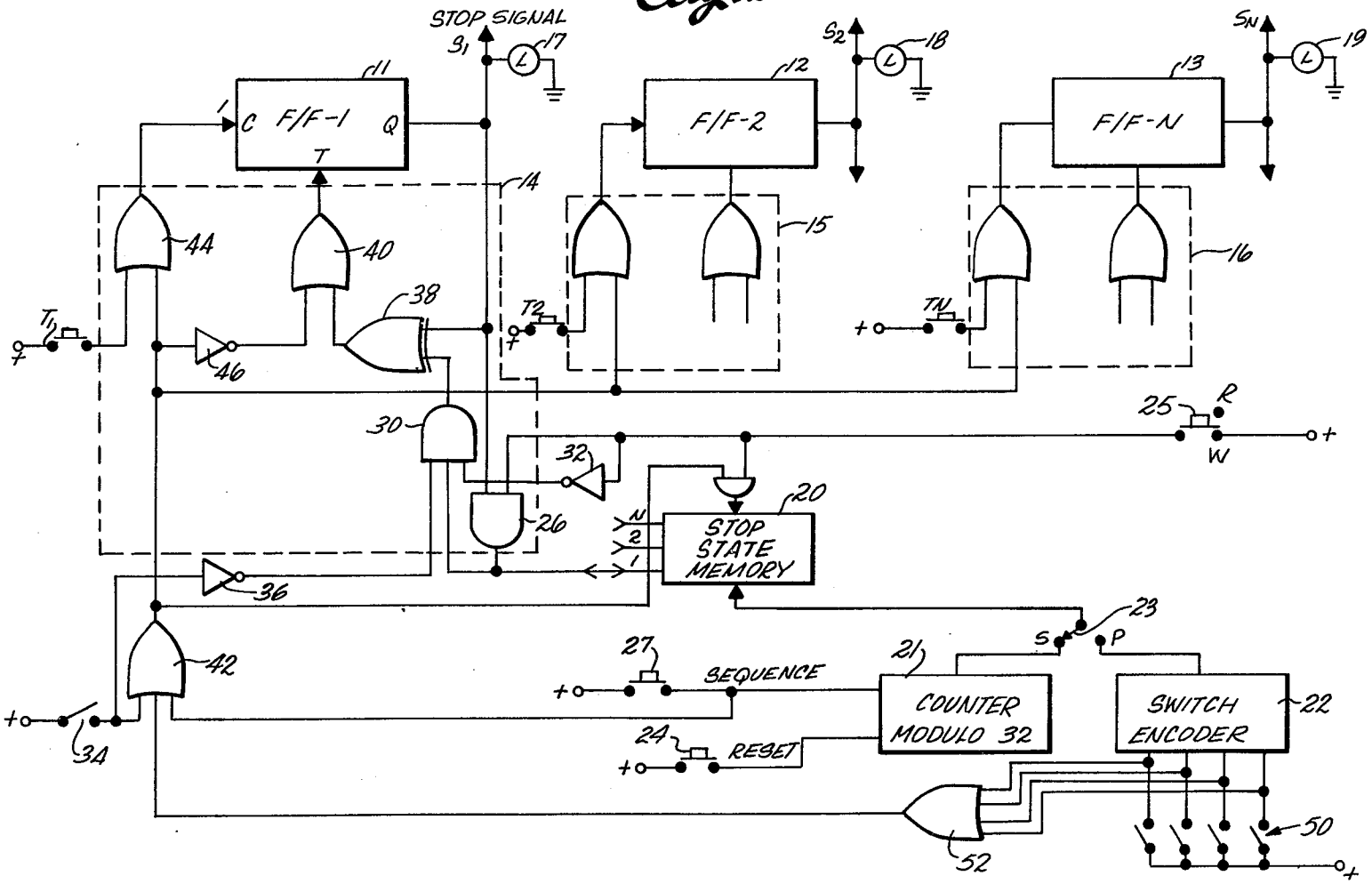
FIG. 1 is a schematic block diagram of one embodiment of the present invention.

Referring to FIG. 1 in detail, there is shown a plurality of tone control flip-flops 1 through N, three of which are indicated at 11, 12, and 13. Each control flip-flop when set to 1 provides a stop signal to an associated one of the tone generators of an electronic musical instrument. For example, the stop control flip-flops may be used to control the stop switches which connect the outputs of the harmonic coefficient memories to a multiplier in the polyphonic tone synthesizer described in U.S. Pat. No. 4,085,644, hereby incorporated by reference. However, the present invention is in no way limited to operation of the stop switches in the instrument described in this patent but can be readily applied to any musical instrument in which tone characteristics are set by a plurality of stop switches.

Associated with each control flip-flop is a flip-flop control circuit, such as indicated at 14, 15, and 16, respectively, for either manually or automatically setting the respective flip-flops. Manually setting each flip-flop is controlled by an associated pushbutton stop switch, indicated at T1, T2 and TN. Whenever the switch T1 is momentarily closed it applies a pulse to the clocking input C of the flip-flop 11 and if the level at the toggle input T is 1, the flip-flop will be complemented, that is, it will change from one state to the other. Thus pushing the switch T1 will either set the associated stop flip-flop to its 0 or its 1 state. A panel indicator light, indicated at 17, 18 and 19, associated with the output of each flip-flop indicates when the flip-flop has been set to 1 and the associated stop is set. Thus a visual indication is provided as to the setting of each of the stops of the instrument after the musician has selectively activated any of the stops by means of the associated switches Tl–TN.

Once the musician has selected a group of stops by turning on the corresponding ones of the control flip-flops 11-13, the status of the flip-flops is stored in a stop state memory 20. The stop state memory is a random access addressable memory containing up to thirty-two addressable word locations, with each word having N bits, corresponding in number to the number of stop control flip-flops. The words in the stop state memory 20 are addressed in sequence from a counter 21 or from a piston switch encoder 22 by manually setting a switch 23 to either the S or the P position, respectively. Assuming that the switch 23 is set into the S position for addressing the memory 20 from the counter 21, the counter 21 is reset initially by momentarily actuating a reset switch 24. The setting of the control flip-flops can then be written into the first word location in the stop state memory 20. To this end, a Read/Write control switch 25 is momentarily closed to write in the status of each of the stop control flip-flops through an AND gate 26 in each of the flip-flop control circuits 14, 15, and 16, respectively. The Read/Write switch is then released and a sequence switch 27 is momentarily closed. This advances the counter 21 to the next count condition for addressing the next word location in the stop state memory 20. At the same time the sequence switch causes any of the control flip-flops which are set to 1 to be reset to 0. The musician can now establish a new set of tone conditions by again selectively activating the tone control switches Tl–TN. On again activating the Read/-Write switch 25, the new set of tone switch conditions are stored in the stop state memory 20 at the next address in sequence, as determined by the counter 21.

After the musician has loaded the stop state memory with all the different stop switch settings required during the subsequent playing of a musical number, he resets the counter 21 by the reset switch 24. This will cause the initial control word in the stop state memory to be read out with the status of each bit being applied to an AND gate 30 in each of the flip-flop control circuits 14 - 16. The AND gate 30 responds to two other inputs, the status of the Read/Write switch 25 applied through an inverter 32 and the status of a cancel switch 34 applied through an inverter 36. Since the outputs of the inverters 32 and 36 are normally at the binary 1 level, the output of the AND gate 30 will be 1 if the corresponding bit from the word being read out of the stop state memory is 1, or will be a 0 if the corresponding bit is 0. The output of the AND gate 30 is applied as one input to an Exclusive OR gate 38 together with the output line from the associated control flip-flop. If the output of the AND gate 30 is 1 and the flip-flop is in the 0 state, the output of the Exclusive OR will be a 1. The output of the Exclusive OR gate 38 is applied to the toggle input of the associated flip-flop to an OR gate. Because of the Exclusive OR gate 38, the toggle input T of the control flip-flop will be a 1 if the status of the flip-flop is different than the status indicated by the corresponding bit read out of the stop state memory 20, so that a pulse applied to the clock input C of the flip-flop will cause the status of the flip-flop to be changed.

All of the flip-flops are clocked in response to actuating the sequence switch 27, the output of which is coupled to each of the flip-flops through a common OR gate 42 and an OR gate 44 in each of the associated control circuits 14-16. Therefore as a result of actuating sequence switch 27, the control flip-flops are set to the status determined by the bits in the word in the stop state memory being addressed by the counter 21. Actuating the sequence switch 27 not only loads the control flip-flops with the appropriate stop settings, but it advances the counter 21 to address the next control word in sequence in the stop memory 20. With the tone controls set to the initial control setting stored in the memory 20, the musician can proceed with playing the instrument. The indicator lights 17-19 provide a visual indication of the setting of the stops. When the musician reaches a point in the musical rendition at which he needs to change to the next tone setting, he merely activates the sequence switch 27, causing the control flip-flops 11-13 to be set to the status determined by the individual bits in the next word in sequence in the stop state memory 20.

At any time the musician can cancel a stop setting by actuating the cancel switch 34. The cancel switch forces the output of the AND gate 30 to the 0 level and causes the associated flip-flops to reset to 0 if they are in the 1 state. The cancel switch not only sets the level at the toggle input of each of the control flip-flops, it provides the clock pulse through the OR gates 42 and 44. It should be noted that an inverter 46 in each of the flip-flop control circuits couples the output of the OR gate 42 to the toggle input of the associated flip-flop through the OR gate 40. The inverter 46 insures that the toggle input is set to 1 at the time the manual stop switch T1 is actuated to set the flip-flop to 1. The inverter 46 insures, however, that clock pulses derived from the output of the OR gate 42 do not influence the setting of the toggle input. It should also be noted that the manual control switches Tl–TN, when actuated, always complement the associated flip-flops. Thus the musician can use these switches at any time to change the status of the associated stop control flip-flop regardless of how it may have been preset by the output of the stop state memory 20. This permits the musician to manually override any preset condition of the stops.

The musician may still elect to use individual pistons as in a conventional combination capture system by setting the switch 23 to the P position. In this position, the switch permits the stop state memory 20 to be addressed from the switch encoder 22 which encodes the setting of any one of a plurality of piston switches indicated at 50 into an address. Thus operating any selected one of the piston switches 50 will cause the stop state memory to be addressed at a predetermined word location for either capturing or setting the status of the stop flip-flops 11-13. An OR gate 52 senses when any one of the piston switches 50 is momentarily actuated to provide a clocking pulse to the flip-flops through the OR gates 42 and 44.

Figure 2:
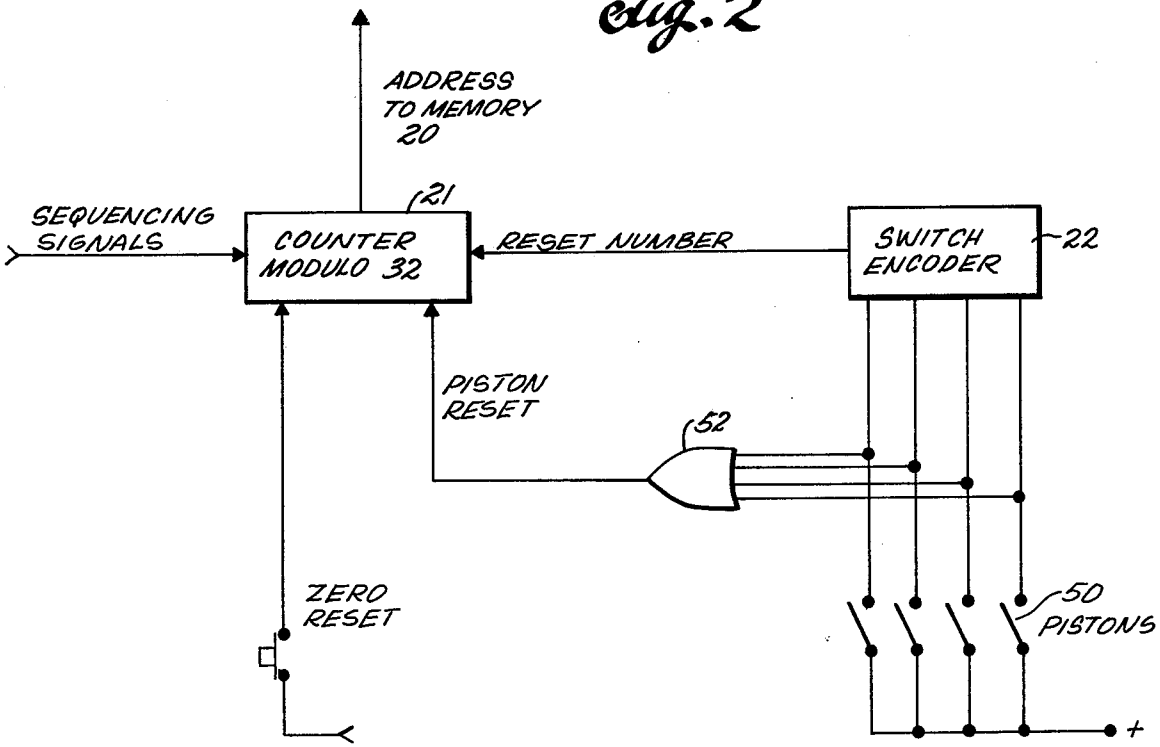
FIG. 2 is a modification of the arrangement of FIG. 1.

FIG. 2 shows an alternative arrangement in which sequencing control and piston control are combined. The output of the switch encoder 22 is applied directly to the counter 21 and the output of the OR gate 52 is also applied to the counter 21 to set the counter to the number determined by the output of the switch encoder 22. Thus actuating any one of the piston switches 50 causes the counter 21 to be set to a particular address in the stop memory 20. By then actuating the sequence switch 27, the preset condition of the word addressed by a particular piston switch is stored in the control flip-flops 11-13 and the counter is sequenced to the next address. Thus each piston can be used to initiate a different sequence of stop combinations.

From the above description it will be seen that a simple stop control circuit is provided which permits sequential operation of preset combinations of tone controls. The state of any control can be changed independently of the preset combinations. The light indicators continually provide the musician with a visual indication of the settings of the tone controls. This system can be reset to start or re-start a sequence and the pistons can be used to select different stored sequences.

What is claimed is:

1. A capture combination tone setting system for an organ or the like having a plurality of tone control stops which can be individually turned on or off, comprising:

a bistable device associated with each stop for controlling the state of the stop, a control circuit associated with each device including a tone control push-button switch for changing the state of the associated bistable device each time the switch is activated, indicator means for indicating the state of each bistable device, an addressable read/write memory for storing a plurality of tone setting control words in separately addressable locations, means including a counter for addressing the memory at a location corresponding to the setting of the counter, means responsive to the states of the bistable devices for generating a word coded to identify the states of the devices, means including a write control switch for writing said word in memory at the address fixed by the counter when the switch is actuated, means including a sequence control switch for advancing the counter by one and resetting the bistable devices to an initial state when the sequence control switch is activated, means responsive to said sequence control switch when the write control switch is off for reading out a word from the address in memory fixed by the counter, changing the states of selected devices in response to said word and incrementing the counter, a plurality of tone combination setting switches, means for presetting a unique address in the counter in response to operation of any of said tone combination setting switches, whereby each tone combination switch selects a predetermined starting word location in memory for subsequent sequencing by the counter.

* * * * *